US006953172B2

(12) United States Patent
Moser

(10) Patent No.: US 6,953,172 B2
(45) Date of Patent: Oct. 11, 2005

(54) ROLL CHANGER AND PROCESS FOR REMOVING A RESIDUAL ROLL FROM AN AXLE

(75) Inventor: Hans Moser, Utzigen (CH)

(73) Assignee: Maschinenfabrik WIFAG, Bern (CH)

( * ) Notice: Subject to any disclaimer, the term of this patent is extended or adjusted under 35 U.S.C. 154(b) by 0 days.

(21) Appl. No.: 10/271,573

(22) Filed: Oct. 15, 2002

(65) Prior Publication Data

US 2003/0071162 A1 Apr. 17, 2003

(30) Foreign Application Priority Data

Oct. 15, 2001 (DE) ..... P 101 50 810

(51) Int. Cl.[7] ..... B65H 16/06
(52) U.S. Cl. ..... 242/596.5
(58) Field of Search ..... 242/596, 596.3, 242/596.4, 596.5, 596.6, 399.1, 563

(56) References Cited

U.S. PATENT DOCUMENTS

| | | | | |
|---|---|---|---|---|
| 1,491,200 A | * | 4/1924 | Cline | 242/596.5 |
| 1,867,764 A | * | 7/1932 | Rust | 242/596 |
| 3,097,808 A | * | 7/1963 | Williams | 242/596.5 |
| 3,123,314 A | * | 3/1964 | Bruestle | 242/399.1 |
| 3,207,452 A | * | 9/1965 | Haskin, Jr. et al. | 242/596.5 |
| 3,381,912 A | * | 5/1968 | Huck | 242/596.5 |
| 4,211,375 A | | 7/1980 | Weiss et al. | |
| 4,265,411 A | * | 5/1981 | Fasolak | 242/596.1 |
| 4,458,851 A | * | 7/1984 | Tokuno et al. | 242/559 |
| 4,609,915 A | | 9/1986 | Erkens | |
| 4,757,953 A | * | 7/1988 | Maier et al. | 242/563 |
| 4,887,070 A | | 12/1989 | Pinto et al. | |
| 4,951,894 A | | 8/1990 | Young, Jr. et al. | |
| 5,050,271 A | | 9/1991 | Hösel | |
| 5,123,604 A | | 6/1992 | Hammer et al. | |
| 5,315,289 A | * | 5/1994 | Fuller et al. | |
| 5,486,691 A | * | 1/1996 | Dieterle | |
| 5,563,581 A | * | 10/1996 | Kats | |
| 6,042,047 A | * | 3/2000 | Thievessen | 242/559.4 |
| 6,276,628 B1 | | 8/2001 | Focke et al. | |
| 6,328,249 B1 | * | 12/2001 | Ogawa et al. | 242/559.2 |
| 2002/0130214 A1 | | 9/2002 | Nakamura et al. | |

FOREIGN PATENT DOCUMENTS

| | | |
|---|---|---|
| DE | 76 07 709 | 6/1977 |
| DE | DD-PS 135 233 | 4/1979 |
| DE | 28 14 338 | 10/1979 |
| DE | 29 28 507 C | 1/1981 |
| DE | 33 21 621 | 12/1984 |
| DE | 37 33 972 | 4/1989 |
| DE | 39 12 737 | 10/1990 |
| DE | 40 13 092 | 9/1991 |
| DE | 296 02 098 | 5/1996 |
| DE | 198 06 432 | 8/1999 |
| GB | 2 058 269 | 4/1981 |

* cited by examiner

*Primary Examiner*—William A. Rivera
(74) *Attorney, Agent, or Firm*—McGlew and Tuttle, P.C.

(57) ABSTRACT

A roll changer for a web-treating or web-processing machine, or a web-fed printing press is provided. The roll changer includes a first roll arm (4) with a first axle journal (8), which can be pivoted about a pivot axis (3), and a second roll arm (5) with a second axle journal (8), which can be pivoted about the pivot axis (3) together with the first roll arm (4). The axle journals (8) form a rotary mount for a web roll (10) taken up between the roll arms (4, 5). A first stripper (9) is assigned to the first axle journal (8) and can be moved in relation to the first axle journal (8), in order to strip the web roll (10) from the first axle journal (8). A drive **(11*a*–11*d*) is provided for pivoting the roll arms (4, 5) and moving the first stripper (9). A control device (12) controls the drive (11*a*–11*d*) for a manual removal of a web roll (10) so that the web roll (10) mounted on the axle journal (8) is stripped by the first stripper (9) from the first axle journal (8), while it remains on the second axle journal (8)**.

20 Claims, 6 Drawing Sheets

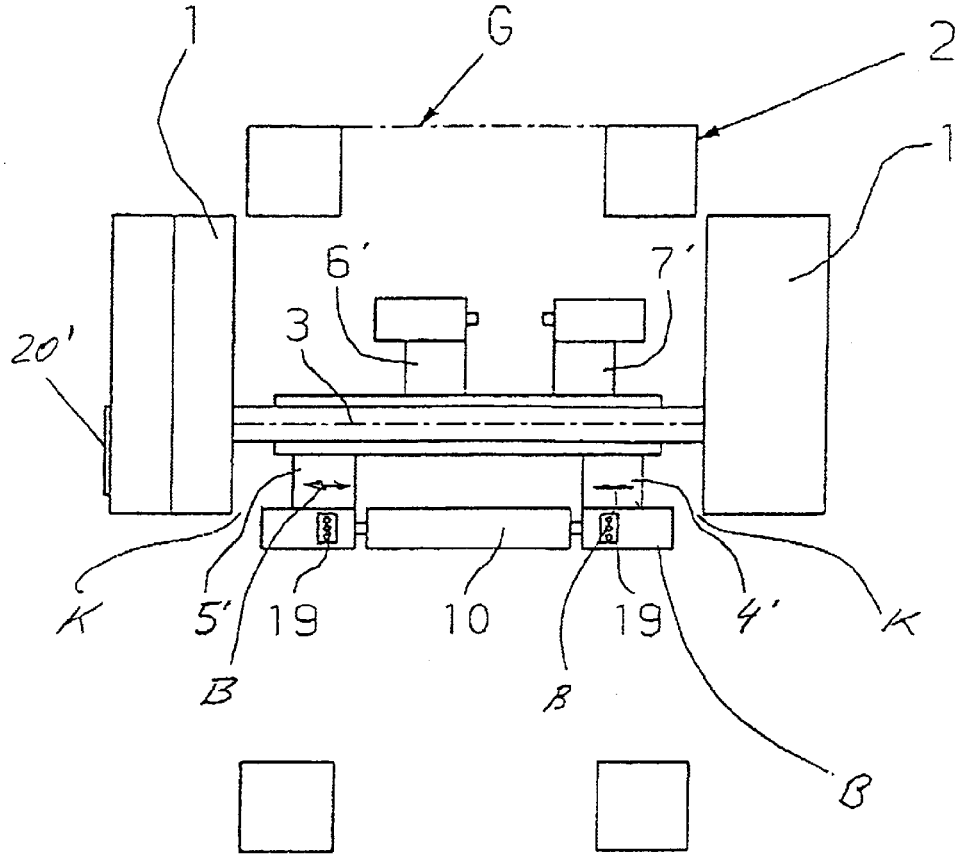
Fig. 4 (State of the Art)

ROLL CHANGER AND PROCESS FOR REMOVING A RESIDUAL ROLL FROM AN AXLE

FIELD OF THE INVENTION

The present invention pertains to a roll changer for a machine for treating or processing a web. One preferred example is a roll changer for a web-fed printing press, particularly for newspaper printing. The present invention also pertains to a process for removing a residual roll from an axle.

BACKGROUND OF THE INVENTION

Depending on the degree of automation, product web rolls, which are introduced during production, so-called residual rolls, are changed fully automatically or manually. The fully automatic roll change is expensive. In prior-art roll changers, for a manual change operating elements or operating stations are arranged at the roll arms of the roll changer that enable the operators, e.g., to pivot the roll arms and to move them away from each other and on top of one another. When the residual roll is removed manually, the operators are exposed to a risk of injury due to the motor-driven parts of the roll changer. Thus, particularly the roll arms, which can be pivoted by a motor and/or can be moved linearly, form trapping sites, e.g., with the frame of the machine, in which an operator may become trapped and as a result injured.

SUMMARY OF THE INVENTION

The object of the present invention is to make it possible to change the residual roll in a simple and less expensive manner. Even so, the safety of the operators is preferably increased when a residual roll is to be removed manually.

The present invention pertains to a roll changer, which comprises at least two roll arms with an axle journal for a rotary mounting of a product web roll, a means for driving the roll arms and a control means for the drive means. The roll arms are designed such that the rolls mounted by them can be rotated about an axis of rotation, and preferably their own central longitudinal axis, and themselves can be pivoted about a pivot axis. Also, the roll arms or at least the axle journals formed by them can be moved towards one another and away from one another in order to pick up a new roll or to remove a residual roll from an axle. A stripper is assigned to at least one of the axle journals. The stripper is used to strip the roll from the assigned axle journal and, correspondingly, can be moved in relation to the assigned axle journal. The relative movability is preferably such that the stripper can be moved relative to the axle journal and to the roll arm of the axle journal. As an alternative, the axle journal can be moved relative to the roll arm and to the stripper. The relative movability may basically be that both the axle journal and the assigned stripper can be moved relative to the roll arm and relative to one another. Preferably, only the stripper performs a stripping movement relative to the axle journal and the roll arm. The drive means is in a position and is coupled with the roll arm in such a manner that each of the said movements can be produced by the drive means.

According to the present invention, the residual roll is removed from an axle asymmetrically in that it is stripped from the assigned axle journal by means of the stripper, but is also mounted by the axle journal of the other roll arm. The stripping of the rolls thus takes place on only one side and in this sense asymmetrically. The control means and the drive means are designed correspondingly and are connected with one another in order to bring about the asymmetrical removal from an axle, and preferably fully automatically without any manual operating procedure.

The roll, which is held alone on the other axle journal after the removal from an axle, may then be comfortably pulled off this axle journal manually and be further handled, e.g., be transported out of the area of the roll changer. Up to the moment at which the roll is still only sitting on the one axle journal, all movements of the pair of roll arms are preferably performed fully automatically by the control means correspondingly controlling the drive means. As soon as the roll to be removed is only sitting on the second axle journal, the drive means is stopped, and preferably automatically by the control means. Preferably, the control means controls the drive means such that the pair of roll arms is automatically pivoted into a comfortable pivoting position for the manual removal, in which they are removed from an axle according to the present invention, with the roll to be removed after the creation of a connection between the web start of a new roll at a running-out web end of the roll to be removed.

In preferred embodiments, at least one stripper is assigned to each of the two axle journals and can be moved relative to its assigned axle journal by means of the drive means, although only one of the axle journals basically has to have a stripper for performing the removal from an axle within a pair of roll arms. The control means is designed so that, in the presence of at least one stripper per axle journal, only one of the strippers is activated separately in order to perform the stripping movement. In a preferred embodiment, the control means has at least two control modes, which are preferably programmed, but which can basically also be implemented as hard-wired control sequences or even by means of machine or fluidics. A first control mode of the at least two modes is processed by the control means for the automatic, manual removal of the roll, and the second control mode of the at least two modes is processed for a fully automatic removal. A selection between the two control modes may advantageously be made at an operating means at the site of the roll changer. However, it may also be advantageous if the selection between the two control modes can only be made at a central machine station. It may also be advantageous if foreseeable roll removals, which are to be performed manually, are also correspondingly automatically preset, e.g., by the control means being correspondingly programmed or by a higher-order machine control means containing corresponding selection commands for selecting between the two control modes.

The control device may also be formed into a regulation means, which regulates the rotary drive of the web roll and/or the pivoting movement of the roll arm and/or the movement of the roll rotary mount for setting and maintaining a certain rotating speed of the roll and/or a certain pivoting position of the roll arm and/or a certain shifting position of the roll rotary mount.

The roll changer also preferably comprises a safety means and a detection means connected with the safety means. The detection means monitors a safety zone which surrounds the roll arms in order to detect whether people are in the safety zone. It performs this function either by detecting only the entering and leaving of the safety zone by formation of a barrier. In a preferred alternative, the part of the safety zone that is safe to walk on is, instead or in addition, monitored in a manner covering an area or even a room. The safety means changes to a blocked state if the detection means detects that a person is in the safety zone. In the blocked state, it prevents at least one of the said motor movements of the roll changer, preferably any movement of a roll changer part that can be brought about by a motor by means of the drive means within the safety zone.

The risk of injury for people, especially for operators, is markedly reduced by monitoring a safety zone defined by means of the detection means. The safety zone thus becomes a protected zone.

The detection means can monitor the protected zone by means of sensors, which detect mechanical actions, e.g., the opening and closing of an access to the safety zone and/or the entering of a surface area at the edge of or within the safety zone. However, the monitoring is preferably carried out by means of an electromagnet in a contact-free manner. It is carried out especially preferably optically.

The detection means may especially be formed by a scanner. A scanning area of the scanner may form the protected zone or a partial area of the protected zone. As an alternative or in combination with a scanner, the protected zone may be protected only or additionally by means of an entrance barrier.

In the formation of a barrier, the entire border of the protected zone is preferably not designed as a contact-free, working barrier, but rather available access obstacles, such as, e.g., a frame or parts of the frame of the roll changer and a control box with an operating console are used for enclosing the protected zone. In addition, it may also be advantageous to form a part of the border by means of a special barrier, e.g., by means of a grid. The contact-free, working barrier or the multiple barriers form the only parts of the border of the protected zone, through which the people may reach the said protected zone in an unhindered manner.

An operating means for the drive means is preferably arranged outside of the protected zone so that it can only be operated by a person located outside of the protected zone. An especially high safety is achieved if operating elements, with whose aid one, several or all of the said types of movement can be motor-driven, are not accessible to a person located in the protected zone.

To further increase the safety, an operating means for the roll changer, with which preferably any, motor-driven movement of the roll changer can be brought about within the protected zone, has at least one operating element for actuating the drive means and additionally a safety element. The safety element is connected with the safety means and permits a movement brought about by the drive means only after its actuation. As long as the safety element has not been actuated, preferably no movement within the protected zone can be brought about by means of the drive means. The safety element is preferably connected with the safety means such that its blocked state is lifted only if at least the following two conditions are met: The detection means detects that any or at least one person, whose presence in the protected zone has triggered the blocked state, has left the protected zone again, and it actuates the safety element. In a simple embodiment, the actuation of the safety element alone is enough.

The safety means and detection means are advantageous even without the asymmetrical stripping of a roll to be removed according to the present invention, such that the applicant reserves the right to claim this part of the present invention as a partial application independently from the stripping of the roll according to the present invention. Thus, particularly the blocking of movable components of a roll changer is also advantageous for any other type of removal from an axle if any operators are involved in the removal from an axle and/or in the removal of any residual roll which has been automatically removed from an axle. The safety means and detection means are also advantageous without a specific reference to the removal of a residual roll from an axle.

A preferred example of the present invention with two different detection means is explained below based on the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4 is a top view showing a roll changer according to the state of the art.

DESCRIPTION OF THE PREFERRED EMBODIMENTS

Figure 1:
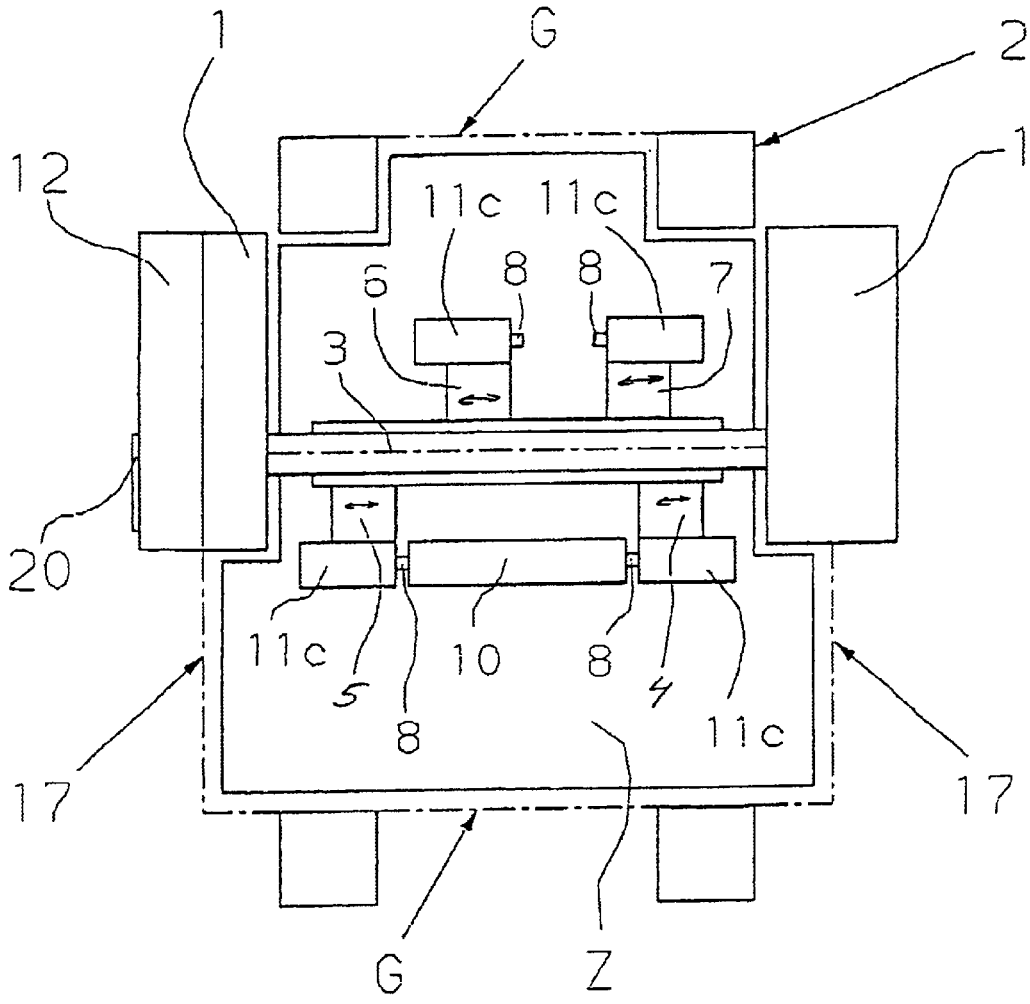
FIG. 1 is a top view of an access-protected roll changer according to the invention

Referring to the drawings in particular, FIG. 1 shows an access-protected roll changer of a web-fed printing press in a top view onto a protected zone Z, which is formed around all parts of the roll changer that are motor-driven and may therefore form hazardous trapping sites for people, and especially for the operators.

Trapping sites K are indicated in FIG. 4 for a roll changer from the state of the art that is identical to the roll changer of FIG. 1 in terms of its roll arms 4', 5', 6' and 7' and its movement possibilities, with the exception of the movement possibility of the stripper, which is explained. Trapping sites K may especially be formed by linear movements of the roll arms 4' through 7' along a common pivot axis 3, e.g., between one of the roll arms 4' through 7' and a frame 1 which supports the pivot axis 3. Such linear movements, which are indicated in FIG. 4 by double arrows in the case of the two roll arms 4' and 5', are necessary when a web roll 10, e.g., a residual roll, is to be removed. Hazardous situations may especially occur in that a drive means, which brings about the linear movements, is actuated manually at operating means 19, which are arranged directly at the roll arms, as is shown in the example of the roll arms 4' and 5'. The operating person is in the immediate vicinity of the roll arm in question during the movement of the roll arm.

In the roll changer of FIG. 1 according to the present invention, for increasing the personal safety, the protected zone Z is formed, which is monitored and is protected at least during the operation of the roll changer, but preferably at any time, such that at least none of the roll arms 4, 5, 6 and 7 can be motor-driven by means of a drive means provided for the roll changer in parallel to the common pivot axis 3, if a person is within the protected zone Z. Although a prevention of the movement of the roll arms 4 through 7 in parallel to the pivot axis 3 already markedly reduces the risk of injury, it is advantageous if a pivot movement of the roll arms 4 through 7 brought about by the drive means is likewise not possible. Even more preferably, the rotary drive of the roll 10 to be removed, which is brought about by the drive means, is also prevented. FIG. 1 shows a rotary drive motor 11*c* of the drive means for each of the roll arms 4 and 5 on both sides of the roll 10. These two motors 11*c* are thus preferably likewise blocked. In an even further preferred embodiment, this likewise applies to strippers 9, which are shown in FIGS. 3*a* through 3*d* and are used to remove the roll 10 from an axle.

The roll arms 4 and 5 form a pair of roll arms, between which the web roll 10 is mounted on an axle journal 8 in a rotary-drivable manner by means of the motors 11*c*. The two other roll arms 6 and 7 form another pair of roll arms for the identical mounting of another roll. The two pairs of roll arms are connected to a shaft which forms the pivot axis 3, in a torsion-proof manner and diametrically opposite one another. The shaft is rotary-mounted on both sides in the frame 1 and is rotary-driven by the drive means for pivoting the pairs of roll arms. The roll arms 4 through 7 are mounted on the shaft individually along the pivot 3 in a linear movable manner. The linear movement is brought about by means of a linear drive, e.g., a motor for each of the roll arms 4 through 7. A rotary drive motor 11*c* each is arranged at the outer ends of the roll arms 4 through 7. In case of a direct drive, the motor shafts of the motors 11*c* directly form the axle journal 8. As an alternative, however, the axle journals may also be rotary-driven via gears. The linear movability of at least one roll arm of each of the pairs of roll arms is necessary for the removal of a residual roll 10 and for the mounting of a new roll as well in the arrangement of roll arms 4 through 7 shown. In addition, the linear movability also makes it possible to pick up rolls of different widths. Thus, the two roll arms 4 and 5 are located in positions for picking up a roll 10 having a maximum width, while the two other roll arms 6 and 7 are located in positions, in which they are able to pick up a roll with half the maximum width. A detailed explanation of the mechanics of the roll changer and also the drive means as such is not necessary, since they can be designed as in conventional roll changers of the type of structure shown. Basically, this also applies to the sequences in a fully automatic roll change.

A roll picked up by the roll arms 6 and 7 is not shown in FIG. 1. In the position of the roll arms 6 and 7 shown, a new roll having half the maximum width is unrolling and being printed on in a print production. A roll 10 having a maximum width was changed to a new roll with half the maximum width, as this is entirely usual with no interruption in production, in order to change, e.g., from one regional insert to another regional insert in the print production of a national newspaper.

Figure 2:
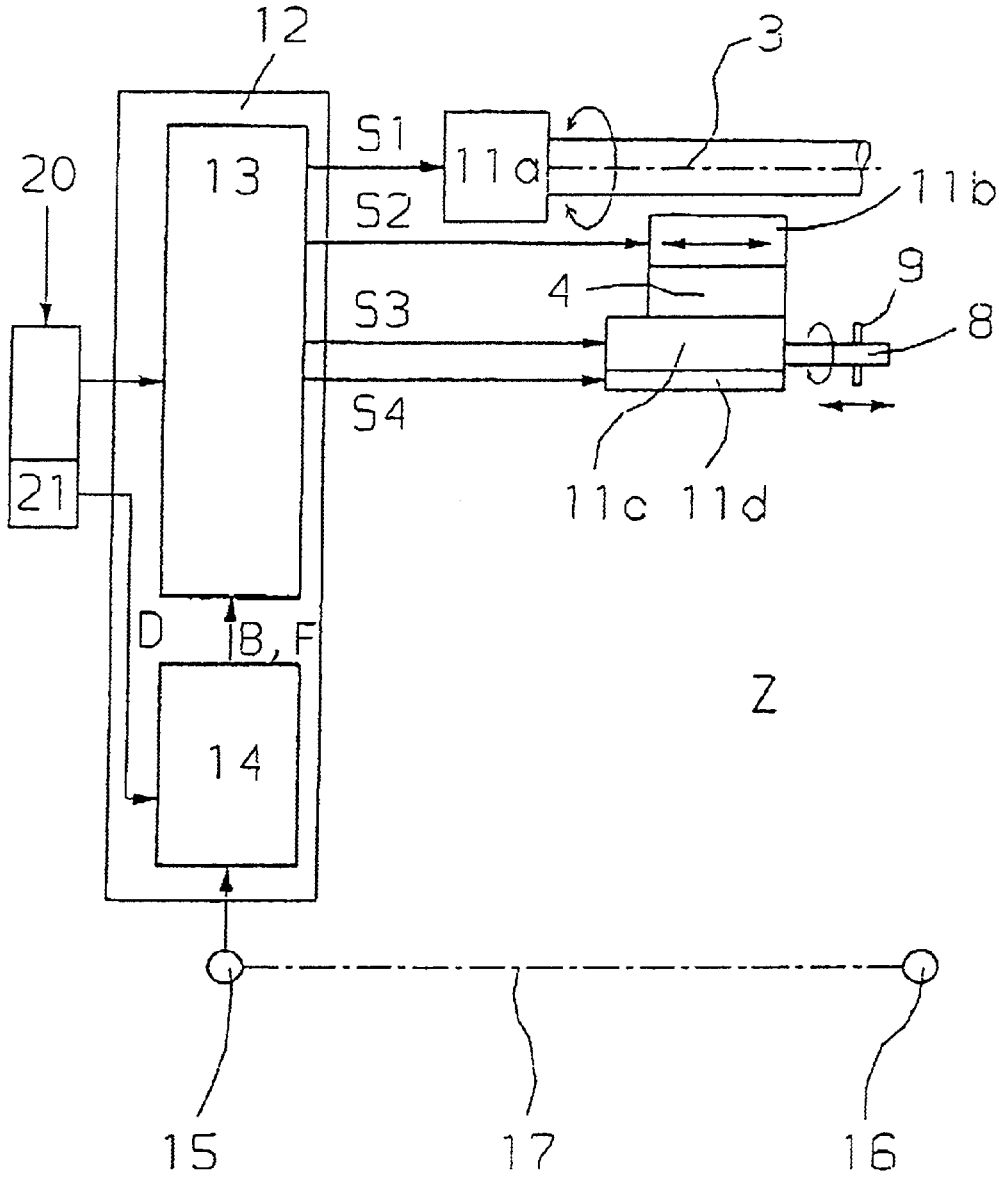
FIG. 2 is a schematic view of a control device including safety device in cooperation with a roll arm of the roll changer of FIG. 1.

FIG. 2 shows the roll arm 4 with the components 11*a* through 11*d* of the drive means acting on it, in a manner that is also representative for the other said roll arms 5, 6 and 7. The components of the drive means acting on or at the roll arm 4 are the motor 11*a* for the pivot drive, a motor 11*b* for the linear movement of the roll arm 4 parallel to the axis of rotation of the roll 10 and the pivot axis 3, the motor 11*c* for the rotary drive of the roll and a linear drive 11*d* for the strippers 9. Movements that can be brought about by means of these drive components are shown symbolically with arrows.

The drive means is controlled by a control means 12. At least the motor 11*c* for the rotary drive of the roll is also preferably regulated. The control means 12 is further preferably also developed for a regulation for the pivot drive 11*a* and even more preferably also for the linear drive 11*b*. The linear drive 11*d* of the stripper 9 is preferably operated only in a controlled manner. However, the control circuits are not shown for the sake of clarity. A control unit 13 of the control means 12 is connected to the drive components 11*a* through 11*d* in order to make it possible to control them and optionally to regulate them by means of position signals S1 for the pivot drive 11*a*, S2 for the linear drive, S3 for the rotary drive 11*c* and S4 for the linear drive 11*d*. The control means 12 also has an operating means 20 connected with the control unit 13. At the operating means 20, the drive components 11*a* through 11*d* can be operated manually, e.g., a desired movement can be triggered or stopped.

The control means 12 also comprises a safety means 14, which is connected with the control unit 13 for the transmission of signals. The safety means 14 may be integrated into the control unit 13. In this sense, the control unit 13, which may be designed as a conventional control with the exception of its cooperation with the safety means 14, and the safety means 14 are shown put together into the control means 12.

The safety means 14 is connected with a detection means. The detection means comprises a light receiver 15 and a light sender 16 that form a light barrier 17 between them. As long as the receiver 15 receives the light of the sender 16, it gives a first output signal to an input of the safety means 14. If the light barrier 17 is interrupted, the output signal of the receiver 15 is changed, so that the safety means 14 recognizes the interruption.

The safety means 14 may assume at least two states, namely a normal state and a blocked state. In the blocked state, it delivers a blocking signal B to the control unit 13, so that the control unit 13 stops one, several or all drives for the pair of roll arms 4 and 5 by means of corresponding position signals. If the safety means 14 assumes the normal state, it does not deliver such a blocking signal. Preferably, in the normal state, it delivers a certain release signal to the control unit 13. If the safety means 14 has recognized an interruption of the light barrier 17 based on the output signal of the said receiver 15 and is in the normal state at the time of recognition, then it changes to the blocked state and delivers its blocking signal B to the control unit 13. If the light barrier 17 is interrupted another time and the safety means 14 is still in the blocked state, then it retains this state. This contributes to safety, since the second interruption may mean that the person, who caused the prior interruption, has left the protected zone Z again, but the second interruption may also mean that another person has entered the protected zone Z. Preferably, the safety means 14 no longer leaves the blocked state once it has been assumed if one or more other interruptions are recognized.

To be able to cancel the blocking of the drive means again, a safety element 21, which can only be actuated manually, is provided in the roll changer outside of the protected zone Z, and preferably as a component of an operating console of the operating means 20. By actuating the safety element 21 an unblocking signal D is delivered to the safety means 14 by the operating means 20 via a signal line. The safety means 14 is again returned to the normal state from the blocked state by means of the unblocking signal D and then delivers the release signal F to the control unit 13. If the release signal F is present at the corresponding input of the control unit 13, then the drive means can again be manually actuated by means of the operating means 20 via the control unit 13. Likewise, the control unit 13 may again automatically run its own control program or a machine control program optionally preset by a higher-order machine control means.

As long as the control unit 13 receives the release signal F from the safety means 14, it controls the drive components 11*a* through 11*d* in accordance with a preset control program or according to the guidelines of the operating means 20. However, if the control unit 13 receives the blocking signal B from the safety means 14, then the linear drive 11*b* is stopped by means of a corresponding position signal S2 until the control unit 13 again receives the release signal F from the said safety means 14. Other drive components 11*a* and 11*d*, and especially preferably all drive components 11*a* through 11*d*, are also preferably stopped by delivery of corresponding position signals S1 and/or S3 and/or S4 in the presence of the blocking signal B.

Based on a preferred exemplary embodiment, the blocking of the drive means was described above in reference to movements of the roll arms 4 and 5, from which the roll 10 is to be removed, by the delivery of the corresponding position signals S1 through S4. However, the safety means could act directly on one or more of the drive components 11*a* through 11*d*, instead of via the control unit 13, by interrupting their energy supply or their current supply in case of electric motors and optionally by actuating available brakes. It would also be conceivable to interrupt power transmission lines to the moved parts of the roll changer or of the individual roll arms that are possibly present, e.g., by means of coupling and uncoupling procedures. The action in terms of position signals of the control means 12 for the drive means only represents one exemplary embodiment, although a preferred one.

As can be seen in the top view of FIG. 1, "natural" obstacles on site are used for the enclosing of the protected zone Z. Such natural obstacles are formed by parts of the frame 1, a control box that contains the control means 12 and building columns 2. In addition, mechanical barriers in the form of grids G or the like may be provided, which prevent the access to the protected zone Z in the areas in question. In the exemplary embodiment, two access possibilities on the sides of the roll arms 4 and 5 are formed, each of which is formed by a plurality of senders 16 and receivers 15, in order to at least prevent a person from unintentionally being able to enter the protected zone Z unnoticed. Intentional attempts to bypass the monitoring system may be ignored for the purpose of the present invention.

The safety means 14 and the detection means may also have complex designs in order not only to detect whether the protected zone Z has been entered, but also in order to detect, e.g., the number of people who are in the protected zone Z exactly. For this the protected zone Z could be monitored with suitable sensors in a manner covering a room or at least covering an area.

Figure 5:
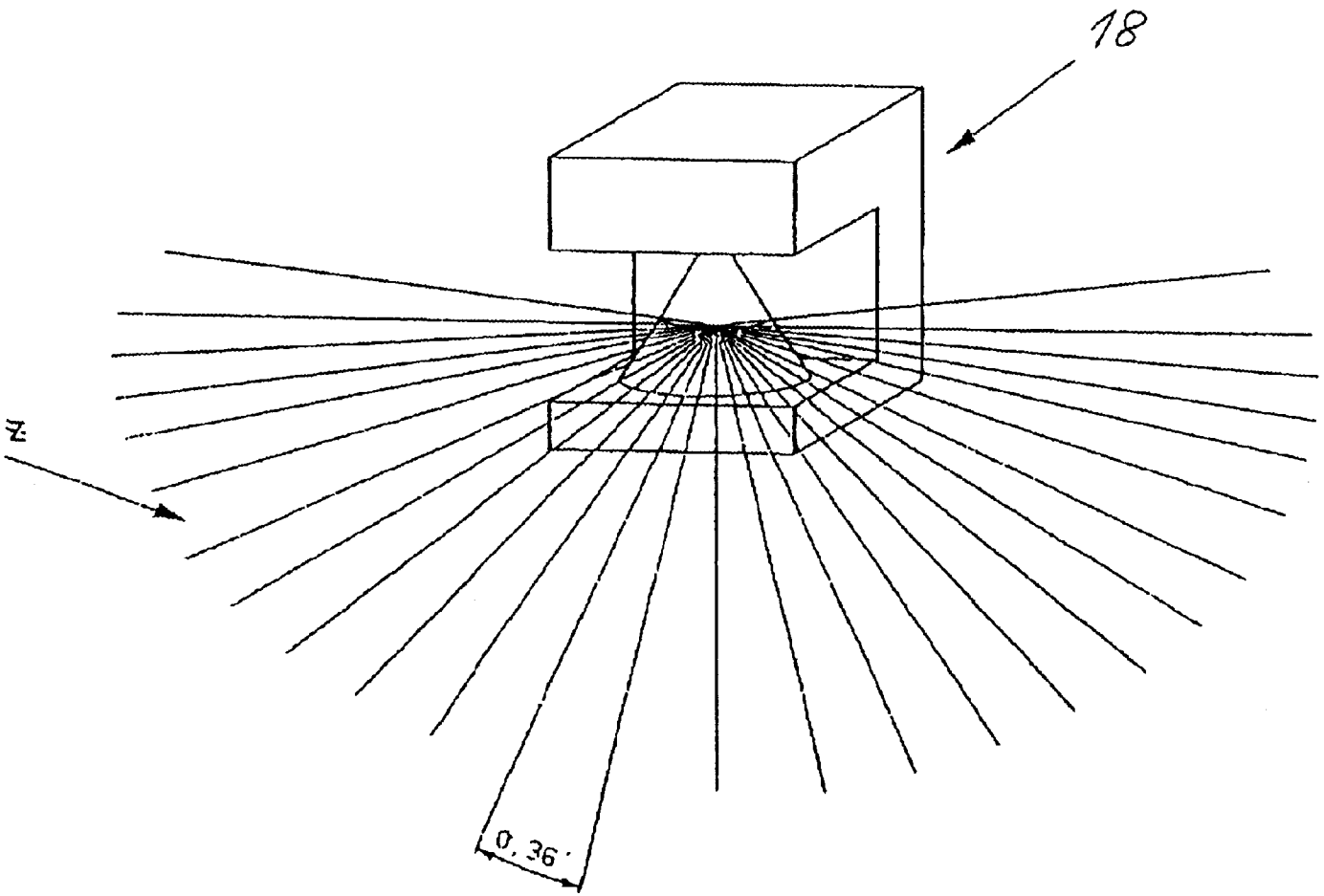
FIG. 5 is a perspective view showing a scanner.

FIG. 5 shows an example of area-covering monitoring. In this example, the detection means comprises a scanner 18 that scans and as a result also only forms a scanning area around itself. The scanner 18 comprises a radiation means for emitting rays and a receiver for receiving reflected rays. In the exemplary embodiment, the scanner 18 forms a scanning area of more than 180° around its radiation means. The lateral resolution of the scanner is 0.36°, i.e., it forms more than 150 sectors in its plane of radiation. The scanner 18 may form the protected zone Z alone, in combination with other such scanners 18 and/or in combination with the already described access barrier. Like the access barrier described, the scanner 18 can cooperate with the safety means 14. Thus, it would deliver the first output signal especially to the input of the safety means 14 as long as its scanning area is free. If its scanning area is disturbed, however, its output signal changes, so that the safety means 14 recognizes the disturbance and changes to the blocked state. Advantageously, the scanner 18 is suitable for also detecting the number of people who are in the protected zone Z exactly. In preferred, simple embodiments, however, it is likewise only detected by means thereof whether a person is in the protected zone Z at all.

FIGS. 3*a* through 3*d* show the sequence of a procedure for removing the roll 10 from an axle when the roll 10 is to be removed from the roll changer manually by the operator.

Figure 3A:
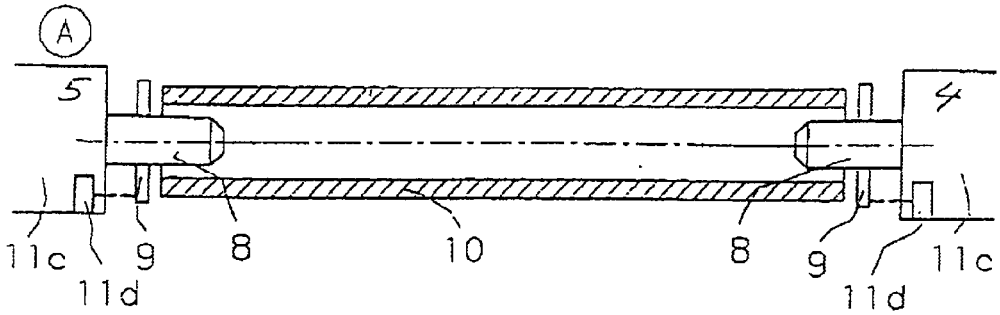
FIG. 3*a* is a partially sectional view showing a step in a procedure of removing a residual roll from an axle.

In FIG. 3*a* the residual roll 10 is mounted between the roll arms 4 and 5 on the two axle journals 8 of the roll arms 4 and 5 axially between the two strippers 9. The axle journals 8 are formed by the motor shafts of the rotary drives 11*c*. One stripper 9 each is assigned to each of the axle journals 8. Each of the strippers 9 may be moved back and forth along its assigned axle journal 8 by means of its linear drive 11*d*.

Figure 3B:
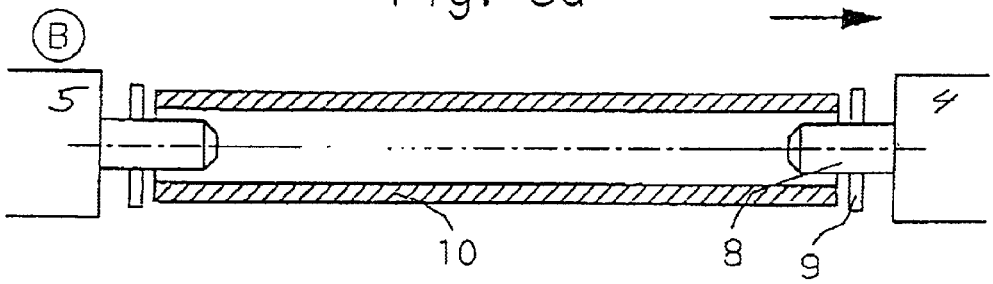
FIG. 3*b* is a partially sectional view showing another step in a procedure of removing a residual roll from an axle.

FIG. 3*b* shows the same residual roll 10 still on both axle journals 8. However, the right roll arm 4 and thus also its axle journal 8 has been moved away from the opposite roll arm 5. At the same time, the stripper 9 for the axle journal 8 of the right roll arm 4 has been moved by the same path as the roll arm 4, but in the opposite direction in relation to the axle journal 8, so that the residual roll 10 has not changed its position in space.

Figure 3C:
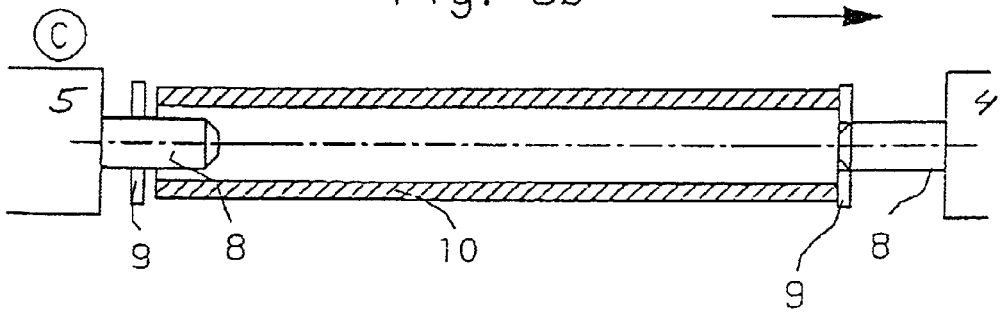
FIG. 3*c* is a partially sectional view showing another step in a procedure of removing a residual roll from an axle.

The moment, at which the axle journal 8 of the right roll arm 4 has extended completely out of the residual roll 10, is shown in FIG. 3*c*. At the same time, its stripper 9 was moved forward up to the front free end of the axle journal 8 of the right roll arm 4, or optionally also a little beyond that. At this time, the residual roll 10 is still only mounted on the axle journal 8 of the left roll arm 4. The left roll arm 5 as well as its stripper 9 have not been moved during the procedure of removing from the axle which is now concluded. Correspondingly, during the procedure of removing from the axle the stripper 9 for the axle journal 8 of the right roll arm 4 has not been moved in relation to its axle journal 8, so that it, together with the residual roll 10, is at a standstill in space during the procedure of removing from the axle which has run up to now. The residual roll 10 is at this time mounted on the axle journal 8 of the left roll arm 5 and still presses against the stripper 9 of the right roll arm 4, so that it still remains in the horizontal position shown in FIG. 3*c*.

Figure 3D:
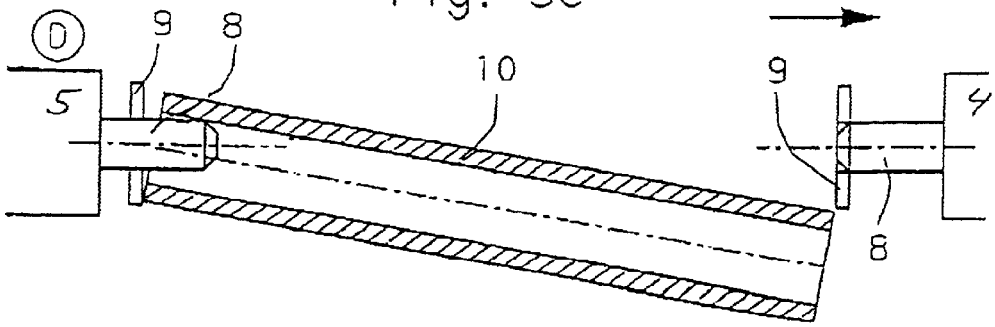
FIG. 3*d* is a partially sectional view showing another step in a procedure of removing a residual roll from an axle.
Figure 3E:
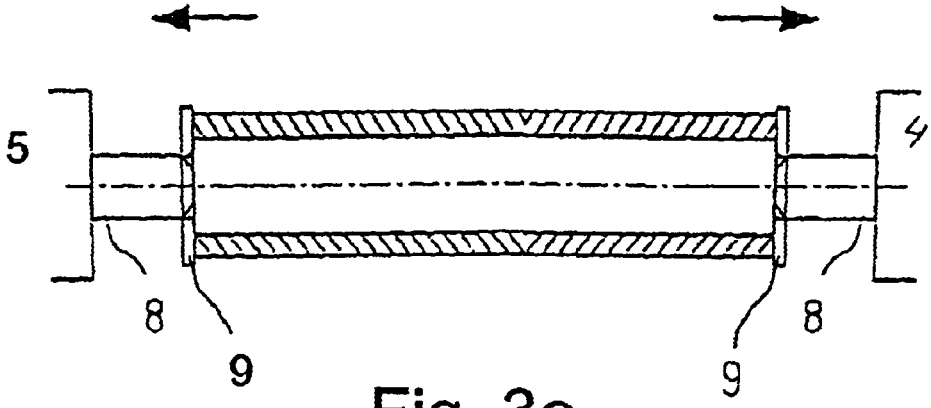
FIG. 3*e* is a partially sectional view showing two strippers moving toward each other in a procedure of removing a residual roll from an axle.

FIG. 3*d* shows the situation after conclusion of the complete procedure of removing from the axle. In comparison to the position shown in FIG. 3*c*, the right roll arm 4 has once again been moved a little away from the left roll arm 5 and, together with it, also the right stripper 9, so that the residual roll 10 is free from the stripper 9 of the right roll arm 4 and is still held only at the axle journal 8 of the left roll arm 5. This results in the slightly sloped position of the residual roll 10 shown in FIG. 3*d*. In this position, the residual roll 10 can very simply be pulled away from the axle journal 8 of the left roll arm 5 manually by the operator and be placed onto a truck.

It is clear that one of the two roll arms involved does not necessarily have to be at a standstill during the procedure of removal from an axle. The procedure for removal from an axle can also be carried out by means of a coordinated movement of both roll arms 4 and 5 and correspondingly coordinated movements of the strippers 9. However, the sequence shown is preferred for the removal from the axle for the purpose of a manual removal of the residual roll 10.

In case of the removal of a roll to be carried out manually in case of a roll change or only a removal for maintenance or repair work, e.g., the process is as follows:

After a new roll, e.g., a roll with half the maximum width, has been inserted between the roll arms 6 and 7 and has been "made sharp" for a subsequent gluing, the two pairs of roll arms 4, 5 and 6, 7 are pivoted about the pivot axis 3, and the glued bond between the running-off end of the residual roll 10 and the web start of the new roll is produced. The pivoting procedure is ended only if the roll 10 to be removed is located in a comfortable position for the manual removal. In this pivoting position the residual roll 10 is removed from the axle either in accordance with a corresponding program control or based on a manual input at the operating means 19 in the manner described based on the FIGS. 3*a* through 3*d*. Up to the removal of the residual roll 10 on one side, as shown in FIG. 3*d*, all movements of the roll changer were effected by means of the drive means automatically with an operating action or fully automatically without any operating action. Optionally, an operation that introduces the procedure for removal from an axle or operations which individually introduce the described phases may be necessary at the operating means 19, even though the removal from the axle on one side preferably runs fully automatically and is also automatically connected to the roll change and the pivoting into the position for removal from an axle.

After the removal from the axle, the operator enters the protected zone Z to pick up the residual roll 10 from the single axle journal 8 still supporting it. The interruption of the light barrier 17 or the disturbance of the scanning area of the scanner 18 caused by the access to the protected zone Z is detected and recorded by the safety means 14. A blocking signal B is delivered to the control unit 13. The drive components are blocked by the control means 12 and, as a result, the pivot drive 11*a*, the two linear drives 11*b* for the roll arms 4 and 5, the two rotary drives 11*c* of the roll arms 4 and 5 and the linear drives 11*d* for the strippers 9 of the roll arms 4 and 5 are stopped. There are therefore no motor movements in the roll changer parts driven by these drive components as long as people are in the protected zone Z. If the operator leaves the protected zone Z again, he again resets the safety means 14 by actuating the safety element 21, so that the safety means 14 delivers the release signal to the control unit 13.

While the stripped residual roll can be manually removed from the only axle journal still supporting it because of the asymmetrical stripping without auxiliary means, especially motor-driven auxiliary means, an especially less expensive possibility is created for removal of the residual roll. Thus, no lifting jack must be made ready, controlled and monitored for the removal of the residual roll according to the present invention.

While specific embodiments of the invention have been shown and described in detail to illustrate the application of the principles of the invention, it will be understood that the invention may be embodied otherwise without departing from such principles.

What is claimed is:

1. A roll changer for a web-treating or web-processing machine or web-fed printing press, the roll changer comprising:

a first roll arm with a first axle journal, which can be pivoted about a pivot axis;

a second roll arm with a second axle journal, which can be pivoted about said pivot axis together with said first roll arm, whereby said first axle journal and said second axle journal form a rotary mount for a web roll taken up between roll arms;

a stripper assigned to said first axle journal and movable in relation to said first axle journal to strip a web roll from said first axle journal;

a drive means for pivoting said roll arms and moving said first stripper, said drive means being connected to said first stripper for driven movement of said stripper;

a control means that controls said drive means for controlled movement of said first stripper for a manual removal of said web roll for a controlled stripping of the web roll mounted on said axle journal by said stripper from said first axle journal while the web roll remains on said second axle journal.

2. A roll changer in accordance with claim 1, further comprising a second stripper assigned to said second axle journal and movable in relation to said second axle journal and another drive means for pivoting said roll arms and moving said second stripper, said another drive means being connected to said second stripper for driven movement of said second stripper by said another drive means to strip the web roll from said second axle journal.

3. A roll changer in accordance with claim 2, wherein said stripper and said second stripper can be moved toward each other by means of said control means and of said drive means to automatically strip the web roll from both said first axle journal and said second axle journal and to hold the web roll in a clamping manner between them.

4. A roll changer in accordance with claim 2, wherein said stripper can be moved separately from said second stripper by means of said control means and said drive means in relation to said first axle journal.

5. A roll changer in accordance with claim 1, wherein said control means has at least two control modes to control said drive means for the removal of the web roll manually according to a first control mode and for a fully automatic removal in another, second control mode.

6. A roll changer in accordance with claim 1, further comprising:

a detection means monitoring a protected zone surrounding said roll arms in order to detect whether a part of a person is in said protected zone;

a safety means connected with said detection means, said safety means in a blocked state preventing said drive means from moving said roll arms parallel to an axis of rotation of said web roll and/or from pivoting about said pivot axis, whereby said safety means assumes the blocked state when said detection means detects that a part of a person is in said protected zone.

7. A roll changer in accordance with claim 6, wherein said control means comprises a operating means for said roll changer, said operating means being arranged outside of said protected zone.

8. A roll changer in accordance with claim 7, wherein said operating means has at least one said operating element for actuating said drive means and additionally has at least one safety element, by whose actuation a blocking of said drive means is brought about by means of said safety means and the blocked state of said safety means is lifted.

9. A roll changer in accordance with claim 6, wherein a blocked state of said safety means is lifted only if said detection means detects that at least a person detected beforehand by said detection means has again left said protected zone.

10. A roll changer in accordance with claim 6, wherein no operating elements are arranged in said protected zone, with which a movement of one of said roll arms parallel to the axis of rotation of said web roll and/or a pivoting movement of one of said roll arms brought about by means of said drive means can be triggered manually.

11. A roll changer in accordance with claim 6, wherein said control means comprises said safety means and stops said drive means by means of a position signal if said detection means detects that a person is in said protected zone.

12. A roll changer in accordance with claim 1, wherein said detection means forms a barrier, as a contact-free, working barrier, for said protected zone.

13. A roll changer in accordance with claim 1, wherein said detection means comprises a scanner to monitor said protected zone in a manner covering an area.

14. A process for removing a residual roll from an axle, which is rotatably mounted between roll arms in a roll changer of a web-treating, web-processing machine, or web-fed printing press, on a first and a second axle journal of roll arms of the roll changer, the process comprising:

providing said machine or press with a first stripper assigned to said first axle journal and for acting on a side surface of a roll, and with a drive means for providing relative movement between said first stripper and said first axle journal back and forth between a journal roll support position with said journal in a position for supporting the roll and a stripped position in which the journal is not in a position for supporting the roll and a control means for controlling said drive means and said relative movement, automatically stripping the residual roll, allowing for a manual removal from the first journal, by driving said first stripper into movement relative to said first journal by said drive means while the residual roll remains on the second axle journal.

15. A process in accordance with claim 14, wherein said roll arms, after a roll change and before the stripping, are pivoted into a comfortable pivoting position for a removal and are stripped on one side in this pivoting position.

16. A process according to claim 14 further comprising:

providing a printing machine in a region around the residual roll and supplying the printing machine with power;

defining a particular safety zone around machine or press;

providing a detecting means for detecting an operator within said safety zone;

stopping the supply of power to at least one of said printing machine and said mscine or press when an operator is detected by said detecting means to be within said safety zone.

17. A process in accordance with claim 14, wherein a second stripper is provided assigned to said second axle journal and movable in relation to said second axle journal and another drive means is provided for pivoting said roll arms and moving said second stripper, said another drive means being connected to said second stripper for driven movement of said second stripper by said another drive means to strip the web roll from said second axle journal.

18. A process according to claim 17, further comprising the steps of:

actuating said second stripper to move said second stripper toward the residual roll with respect to said second journal until the residual roll is clamped between said first stripper and said second stripper.

19. A process in accordance with claim 14, wherein said automatically stripping the residual roll by driving said first stripper into movement relative to said first journal includes substantially maintaining said first striper in position adjacent to the side surface of the roll with the roll substantially maintained in position relative to said second axle journal and moving said first journal relative to said first stripper and relative to said roll.

20. A roll changer for a web-treating or web-processing machine or web-fed printing press, the roll changer comprising:

a first roll arm with a first axle journal, which can be pivoted about a pivot axis;

a second roll arm with a second axle journal, which can be pivoted about said pivot axis together with said first roll arm, whereby said first axle journal and said second axle journal form a rotary mount for a web roll taken up between roll arms;

a stripper assigned to said first axle journal and disposed adjacent to a side surface of a roll supported by said first axle journal for acting on the side surface and movable in relation to said first axle journal to strip a web roll from said first axle journal;

a drive means for pivoting said roll arms and moving said first stripper relative to said first axle journal while said stripper is acting on the side surface of a roll supported by said first axle journal, the movement of said first stripper relative to said first axle journal being back and forth between a journal roll support position with said journal in a position for supporting the roll and a stripped position in which the journal is not in a position for supporting the roll, said drive means being connected to said first stripper for driven movement of said stripper relative to said first axle journal;

a control means that controls said drive means for controlled movement of said first stripper relative to said first axle journal for a controlled stripping of the web roll mounted on said axle journal by said stripper acting on the side surface of the roll to remove the roll from said first axle journal while the web roll may remain in position relative to said second axle journal.

* * * * *